US011786953B2

(12) United States Patent
Hembach et al.

(10) Patent No.: US 11,786,953 B2
(45) Date of Patent: Oct. 17, 2023

(54) APPARATUS FOR NOTCHING, AND PUNCHING SYSTEM

(71) Applicant: HSF AUTOMATION GMBH, Grünkraut-Gullen (DE)

(72) Inventors: Helmut Hembach, Wangen im Allgäu (DE); Robert Kupferschmid, Vogt (DE); Martin Hagel, Baienfurt (DE)

(73) Assignee: HSF AUTOMATION GMBH, Grunkraut-Gullen (DE)

( * ) Notice: Subject to any disclaimer, the term of this patent is extended or adjusted under 35 U.S.C. 154(b) by 4 days.

(21) Appl. No.: 16/757,243

(22) PCT Filed: Oct. 17, 2018

(86) PCT No.: PCT/EP2018/078336
§ 371 (c)(1),
(2) Date: Apr. 17, 2020

(87) PCT Pub. No.: WO2019/076948
PCT Pub. Date: Apr. 25, 2019

(65) Prior Publication Data

US 2021/0187581 A1 Jun. 24, 2021

(30) Foreign Application Priority Data

Oct. 18, 2017 (DE) ..... 10 2017 124 334.8

(51) Int. Cl.
*B21D 28/22* (2006.01)
*B21D 28/12* (2006.01)

(52) U.S. Cl.
CPC ..... *B21D 28/22* (2013.01); *B21D 28/12* (2013.01); *Y10T 83/4607* (2015.04)

(58) Field of Classification Search
CPC ..... B21D 28/12; B21D 28/22; B23Q 5/28; B26F 1/405; B26D 7/015; Y10T 83/4607; Y10T 83/219
(Continued)

(56) References Cited

U.S. PATENT DOCUMENTS 3,890,863 A * 6/1975 Reihle ..... B21D 28/22 83/267
4,311,086 A 1/1982 Schoen
(Continued)

FOREIGN PATENT DOCUMENTS

CN 102814393 A 12/2012
CN 205362333 U 7/2016
(Continued)

OTHER PUBLICATIONS

DE-2411439-A1 English translation; 09-19775 Rundel, Peter H02K15/024.*
(Continued)

*Primary Examiner* — Laura M Lee
(74) *Attorney, Agent, or Firm* — Stites & Harbison, PLLC; James R. Hayne

(57) ABSTRACT

An apparatus for notching comprises a frame with a first stand, a second stand and a headpiece connecting the first stand and the second stand, wherein the stands are arranged to be offset along an x axis with respect to each other. Furthermore, the apparatus comprises a plunger, which is coupled to the headpiece and is movable along a punching axis extending along a y axis.

3 Claims, 5 Drawing Sheets

Figure 1:
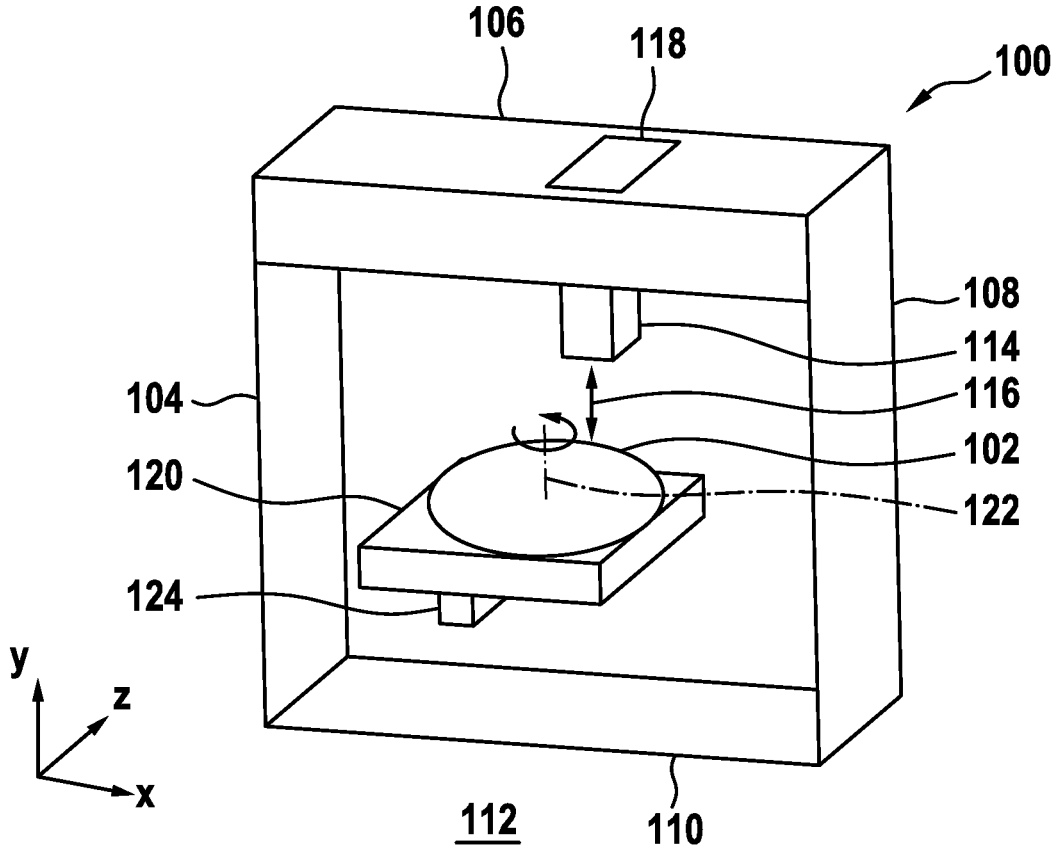

(58) Field of Classification Search
USPC ..... 83/917, 154, 267, 691, 614
See application file for complete search history.

(56) References Cited

U.S. PATENT DOCUMENTS

| | | | | | |
|---|---|---|---|---|---|
| 4,331,049 | A * | 5/1982 | Bergmann | B21D 28/22 | 83/76.6 |
| 4,970,925 | A * | 11/1990 | Nakatsuji | B21D 28/28 | 83/384 |
| 4,993,292 | A * | 2/1991 | Kunz | B23D 15/00 | 83/559 |
| 5,333,525 | A * | 8/1994 | Schlegel | H02K 15/024 | 29/596 |
| 5,911,806 | A * | 6/1999 | Bareis | B21D 28/22 | 83/240 |
| 6,666,063 | B2 * | 12/2003 | Pick | B21D 28/22 | 219/121.67 |
| 7,798,042 | B2 * | 9/2010 | Stein | B26D 5/08 | 83/747 |
| 2002/0005056 | A1 * | 1/2002 | Pick | B21D 28/22 | 72/324 |
| 2002/0072456 | A1 * | 6/2002 | Ichikawa | B21D 28/12 | 483/1 |
| 2004/0154453 | A1 * | 8/2004 | Kobayashi | B21D 28/125 | 83/691 |
| 2004/0169069 | A1 * | 9/2004 | Ostini | B21D 28/12 | 234/109 |
| 2007/0227223 | A1 * | 10/2007 | Utpadel | B21D 43/02 | 72/421 |
| 2008/0163734 | A1 | 7/2008 | Konrad | | |
| 2014/0000433 | A1 * | 1/2014 | Yamamoto | B26D 7/2621 | 83/886 |
| 2019/0217360 | A1 * | 7/2019 | Kappes | B21D 28/12 | |

FOREIGN PATENT DOCUMENTS

| | | | | |
|---|---|---|---|---|
| DE | 2411439 | A1 * | 9/1975 | H02K 15/024 |
| DE | 2931754 | | 2/1981 | |
| DE | 3902935 | A1 * | 8/1990 | B26F 1/405 |
| DE | 20301895 | | 6/2004 | |
| EP | 2330721 | | 6/2011 | |
| FR | 2269814 | | 11/1975 | |
| JP | 2003260521 | | 9/2003 | |

OTHER PUBLICATIONS

DE-3902935-A1 English translation; Aug. 1990 DE Jung Klaus Dipl Ing B26F1/405.*
International Search Report for PCT/EP2018/078336, dated Feb. 27, 2019.
Written Opinion of the International Searching Authority for PCT/EP2018/078336, dated Feb. 27, 2019.
German Search Report for DE 10 2017 124 334.8, dated Feb. 21, 2019.
Chinese Office Action, Application No. 201880068169.7, dated: Nov. 19, 2021. 16 pages.

* cited by examiner

APPARATUS FOR NOTCHING, AND PUNCHING SYSTEM

The present invention relates to an apparatus for notching and to a punching system.

Notching presses are employed for producing rotor and stator sheets for electric motors and generators, for example. In small-batch series or due to large sheet diameters, production in a compound die is not profitable owing to the costs. Therefore, the sheets are produced in several punching processes with a single notching punch, the so-called single notching.

Notching presses are configured as C frame punch presses. The punch presses have an electrical speed-regulated main drive driving a flywheel and transmitting the force to the mechanical drive components and eventually the plunger via a coupling/brake combination. The backwardly protruding section of the C frame of these machines is used for accommodating the main drive and the further drive elements for force transmission.

DE 195 37 475 A1 discloses a notching press having a C frame.

It is the object of the present invention to provide improved apparatus for notching and an improved punching system.

This object is achieved by apparatus for notching and a punching system in accordance with the main claims.

The apparatus for notching comprises an archway-shaped, according to one embodiment O-shaped frame. Such a frame has a series of advantages, for example with respect to the usable tools, the workpieces to be machined or the possibilities of automation.

A corresponding apparatus for notching comprises:

a frame with a first stand, a second stand and a headpiece, wherein the stands are arranged to be offset from each other along an x axis; and a plunger, which is coupled to the headpiece and is movable along a punching axis extending along a y axis.

The apparatus for notching is also referred to as a notching press, punching press or machine. The apparatus may serve as a replacement for known notching presses. For example, the apparatus may be employed for producing stator and rotor sheets for electric machines. The frame may be anchored safely to the ground during assembly of the apparatus. To this end, the stands may be connected to the ground or alternatively to an optional table frame in the assembled state of the apparatus. The stands may be formed to be pillar-shaped. The stands may be formed to be straight or curved. The headpiece may represent a connection between the first stand and the second stand. For example, the headpiece may connect free ends of the stands facing away from the ground. The headpiece may be formed to be straight or curved. The stands and the headpiece may represent portions of the frame in the operational state of the apparatus. The stands and the headpiece may be formed as a separate parts connected to form the frame. As an alternative, the frame may comprise one or more parts which may be associated both with a stand and with the headpiece. Thus, the frame may also be formed to be integral, for example as a so-called mono block. The stands and the headpiece form archway surrounding a workspace. The plunger may be moved back and forth linearly along the punching axis. An end of the plunger facing away from the headpiece may comprise or accommodate a tool for punching a notch into a workpiece.

The apparatus may comprise an indexing head for accommodating a workpiece to be machined. The indexing head may be configured to rotate the workpiece about an indexing head axis oriented along the y axis, wherein the indexing head axis and the punching axis are arranged to be offset from each other along a z axis.

The indexing head may be connected to the frame or to the ground in the assembled state of the apparatus. The indexing head may be a device as is already employed in known notching presses. The indexing head may comprise means for holding the workpiece and for rotating the workpiece around the indexing head axis. A plane passing through the indexing head axis and the punching axis may be oriented in a transverse or at least slant manner with respect to a longitudinal axis of extension of the headpiece. The x, y and z axes may be oriented at least transversely, in particular orthogonally, with respect to each other. Thereby, the workspace extending in parallel to and x-y plane may be spanned by the frame. The indexing head axis may be arranged abeam with respect to the x-y plane and outside the workspace. Advantageously, the workpiece, for example sheet metal to be machined, may be moved transversely with respect to the longitudinal direction of extension of the headpiece when being supplied to the apparatus or when being removed from the apparatus.

Thus, the indexing head may be configured to the workpiece along the z axis. The movement axis may extend transversely with respect to the longitudinal axis of extension of the headpiece. This allows for moving the workpiece the workspace surrounded by the frame along a longitudinal movement axis extending between the stands. Additionally or alternatively, the indexing head may be configured to move the workpiece along the x axis. This allows for moving the workpiece at first along the z axis and then along the x axis for further machining or simultaneously along the z axis and the x axis, for example.

The frame may comprise a table frame connecting the first stand and the second stand. The headpiece and the table frame may be arranged offset from each other along the y axis. Stability of the apparatus can be enhanced by means of the table frame. As already explained, the frame may be formed in one piece or as multiple pieces.

The apparatus may comprise a drive for driving the plunger. The drive may comprise an electric motor arranged on the headpiece for driving an eccentric coupled to the plunger. For example, the plunger may be coupled to the eccentric via a connecting rod. Advantageously, reciprocating movement of the plunger can be realized using the electric motor.

The apparatus may comprise an electrical direct drive for driving the plunger. Advantageously, such a direct drive may be arranged directly in the headpiece. The direct drive may be realized using few components and allows for very precise movement of the plunger.

The apparatus may comprise an upper tool part and a lower tool part. The upper tool part may be attached to a free end of the plunger. The lower tool part may be attached to a table plate coupled to the frame opposite to the upper tool part. The tool parts may be used corresponding to known notching presses to punch a notch in the workpiece. To this end, the upper tool part may be pressed in the direction of the workpiece against the workpiece through movement of the plunger.

The plunger may be movable to a top reversal point, for example a top dead center, at which the upper tool part and the lower tool part are spaced apart from each other without overlap. Thereby, a continuous and linear gap for completely feeding the workpiece through between the upper tool part and the lower tool part along with the z axis can be produced along the entire width of the workpiece along the x axis. Thus, the gap may not only extend across a subsection of the tool parts, but continuously across the next higher extension of the tool parts. Advantageously, the plunger may be moved to the top reversal point prior to the beginning of machining the workpiece and additionally or alternatively following completion of machining the workpiece. This allows for feeding the workpiece along the gap completely through the workspace surrounded by the frame. For example, the workpiece may be supplied from one side of the frame and may be removed from the other side of the frame. This is particularly advantageous in the context of an automated punching system. A tool part may hear be a tool in itself or a combination of a tool and a tool frame holding the tool.

A punching system comprises:

a providing unit for providing an unmachined workpiece;

an apparatus as mentioned, which is configured to punch at least one notch into the unmachined workpiece, in order to obtain at least one machined workpiece;

a repository for depositing the machined workpiece; and a moving unit configured to move the unmachined workpiece from the providing unit to the apparatus and to move the machined workpiece from the apparatus to the repository.

The providing unit may be a known device capable of accommodating a stack of unmachined workpieces or an unmachined workpiece, for example. The repository may be a known device capable of accommodating a stack or a machined workpiece. The over may be configured to pick up the unmachined workpiece from the providing unit and deposit it on the indexing head of the apparatus. Furthermore, the moving unit may be configured to pick up the machined workpiece from the indexing head and deposit it on the repository. The moving unit may comprise one or more units, which may also be arranged separately from each other, for example on different sides of the frame of the apparatus.

For example, the moving unit of the punching system may comprise a rotational movement axis oriented along the y direction. The moving unit may correspondingly be configured to perform at first rotational movement about the rotational movement axis for moving the unmachined workpiece to the apparatus and a second rotational movement about the rotational movement axis for moving the machined workpiece to the repository. The first rotational movement and the second rotational movement may have the same rotational direction. In this way, the providing unit, the apparatus and the repository may be arranged strung along a circular path.

As an alternative, the moving unit may comprise a longitudinal movement axis oriented along the z direction. The moving unit may be configured to perform a first movement along the longitudinal movement axis for moving the unmachined workpiece to the apparatus and additionally or alternatively a second movement along the longitudinal movement axis for moving the machined workpiece to the repository. The first movement and the second movement may have the same direction. In this way, the providing unit, the apparatus and the repository may be arranged strung along a line, wherein the apparatus may be arranged between the providing unit and the repository. In this case, the workpiece may be moved completely through the workspace defined by the frame of the apparatus.

Figure 2:
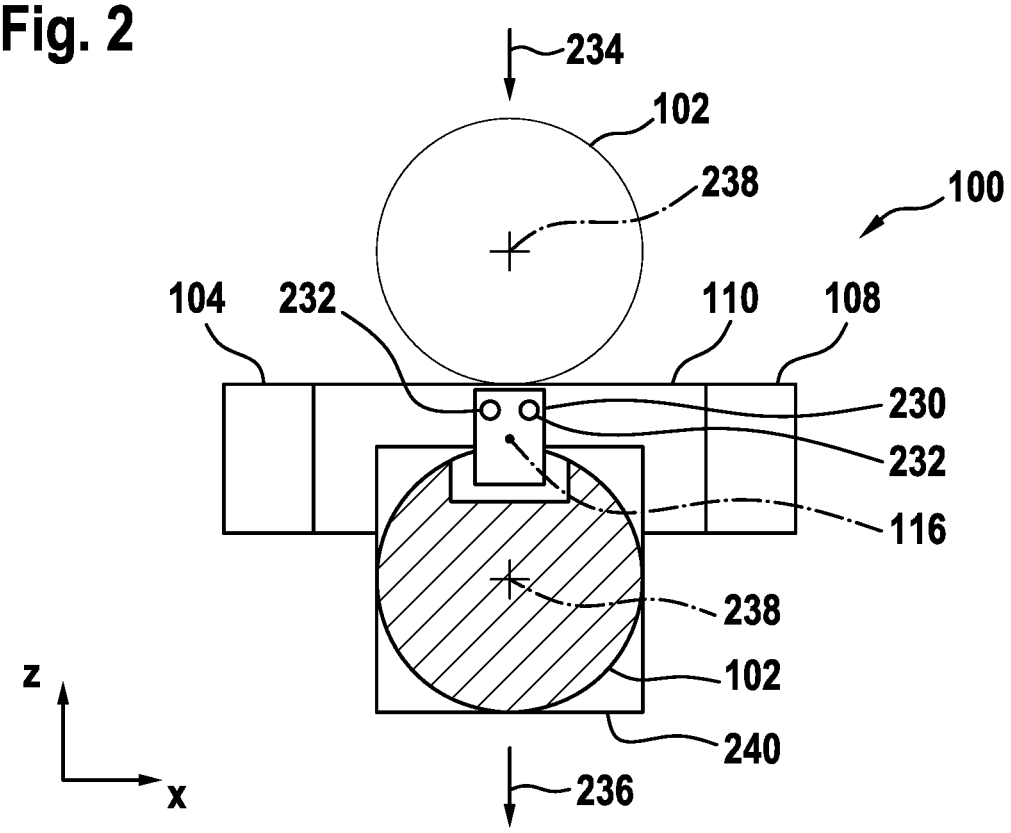
Figure 3:
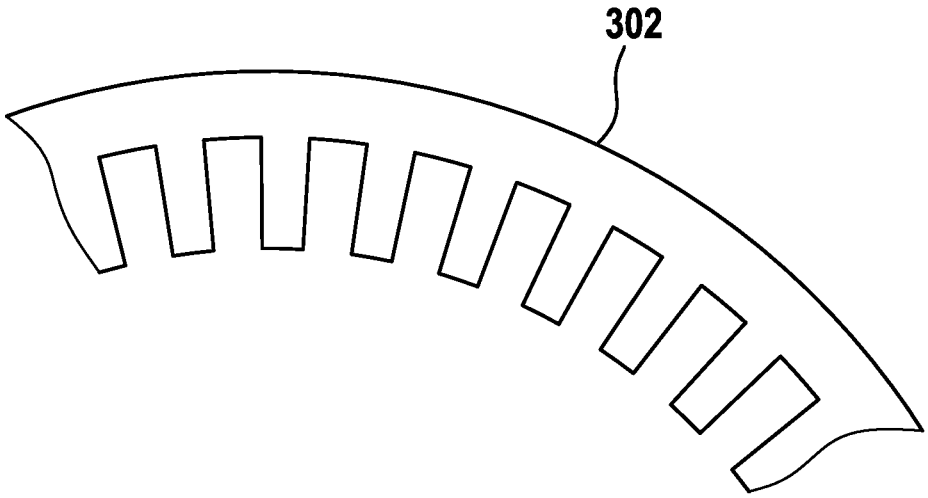
Figure 4:
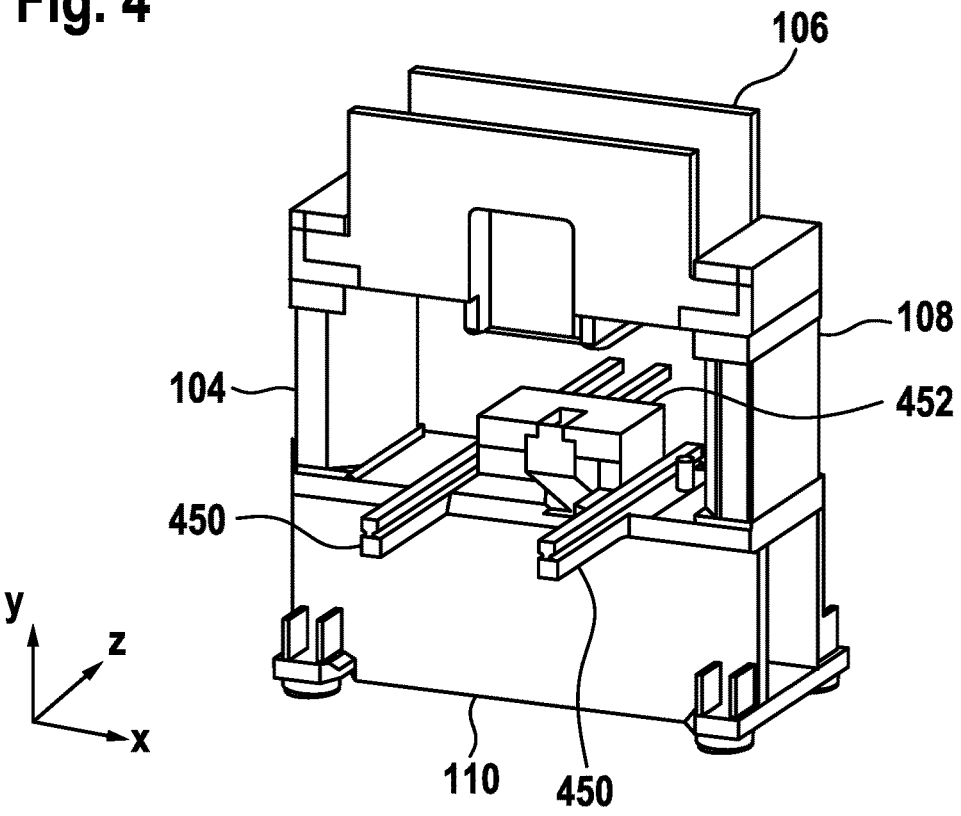
Figure 5:
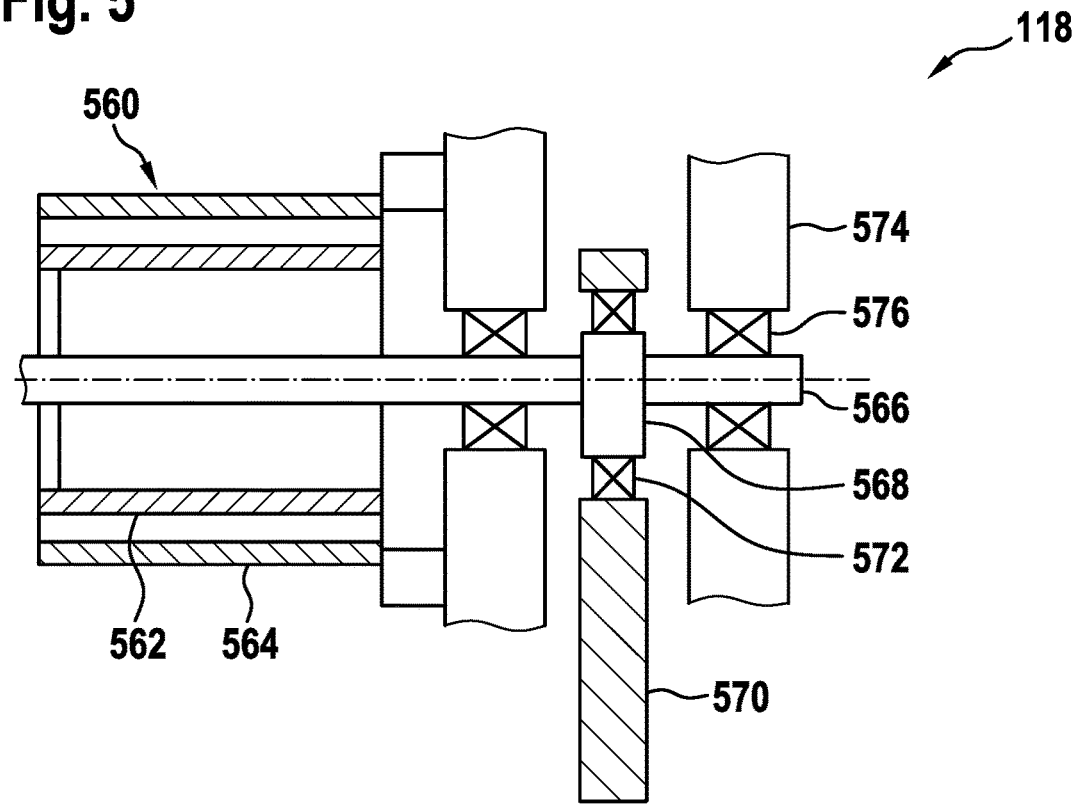
Figure 6:
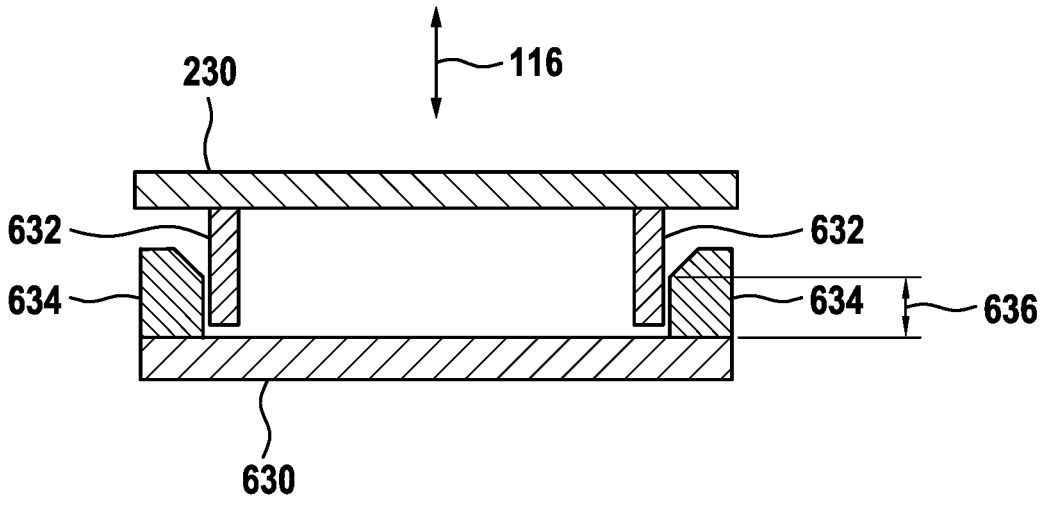
Figure 7:
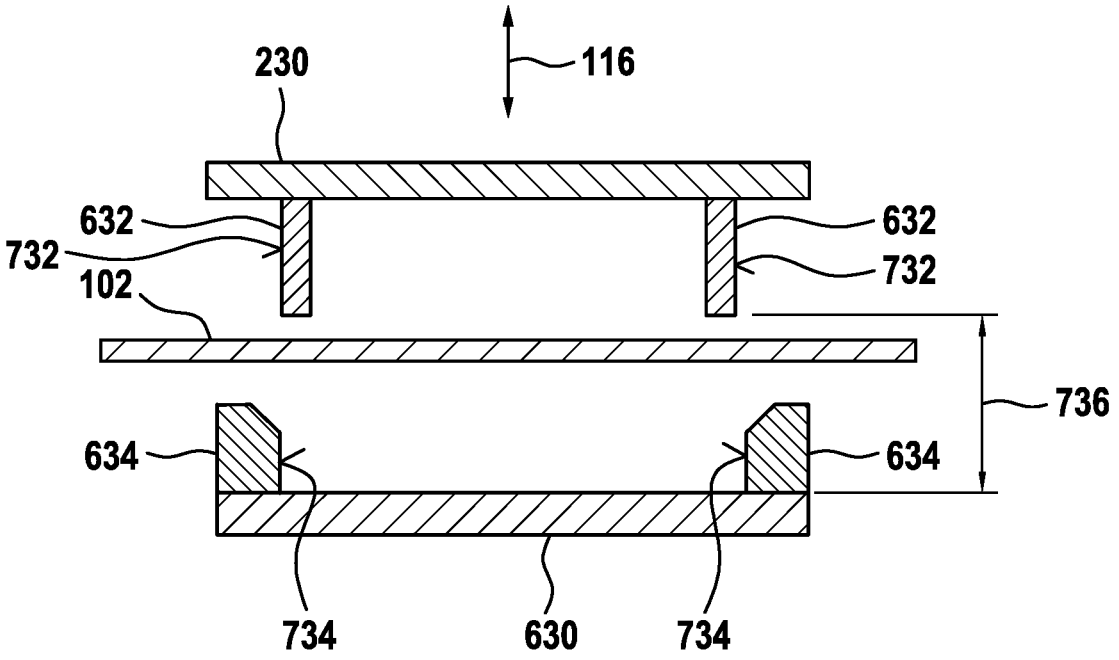
Figure 8:
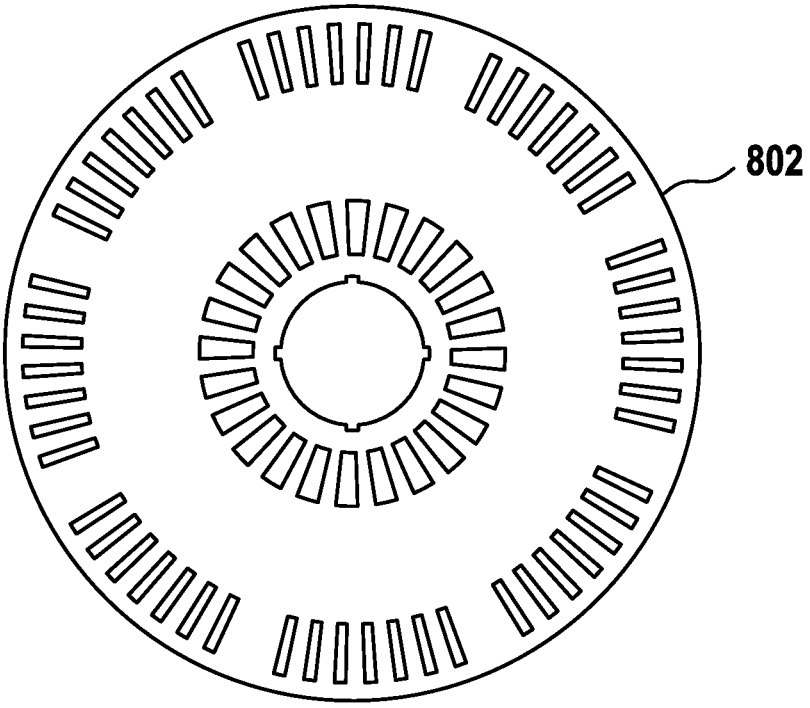

Preferred embodiments of the present invention shall be explained in greater detail in the following with reference to the accompanying drawings, in which:

FIG. 1 shows a schematic illustration of an apparatus for notching according to an embodiment;

FIG. 2 a sectional view of an apparatus for notching according to an embodiment;

FIG. 3 a machined workpiece according to an embodiment;

FIG. 4 an illustration of a frame of an apparatus for notching according to an embodiment;

FIG. 5 a schematic illustration of a drive according to an embodiment;

FIG. 6 a schematic illustration of a tool cartridge according to an embodiment;

FIG. 7 a schematic illustration of a tool cartridge according to an embodiment;

FIG. 8 a machined workpiece according to an embodiment; and

Figure 9:
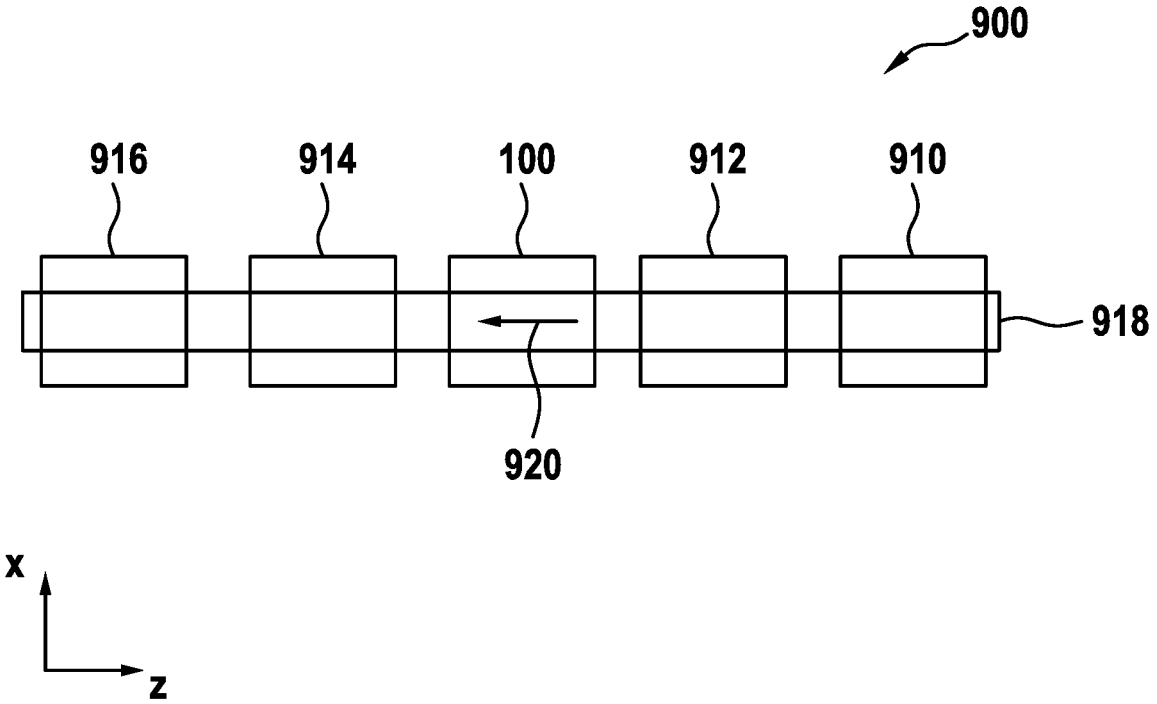

FIG. 9 a schematic illustration of a punching system according to an embodiment.

In the subsequent description of the preferred embodiments of the present invention, the same or similar reference numerals shall be used for the similarly functioning elements illustrated in the various figures, wherein repeated description of these elements shall be omitted.

FIG. 1 shows a schematic illustration of an apparatus 100 for notching according to an embodiment. The apparatus 100 is used to machine a workpiece 102. The apparatus 100 comprises a frame including at least a first stand 104, a headpiece 106 and a second stand 108. Optionally, the frame includes a table frame 110. In the assembled state of the apparatus 100, for example, the frame is mounted to the ground 112 of a production hall. The frame may be formed in one piece or as several pieces. Thus, the stands 104, 108, the headpiece 106 and the optional table frame 110 may, for example, represent separate components connected to form the frame or only representing portions of the frame, which may also be formed as a mono block, for example.

According to an embodiment, the stands 104, 108 have a main direction of extension along a y axis, and the headpiece 106 has a main direction of extension along an x axis of an orthogonal coordinate system. The headpiece 106 spans a gap between the stands 104, 108, which are arranged offset from each other along the x axis according to this embodiment. The frame thus forms a gateway, or a window together with the table frame 110, enclosing a workspace. A main plane of extension of the workspace, also referred to as workspace plane, extends in parallel to the x-y plane. Thus, the workspace is limited laterally by the stands 104, 108, upwardly by the headpiece 106 and downwardly by the ground 112 or the table frame 110.

The apparatus 100 includes a plunger 114 which can be moved back and forth, here the up and down, along a punching axis 116. The plunger 114 is coupled to the headpiece 106. The plunger 114 may be driven by a drive 118. According to an embodiment, the drive 118 is arranged on the headpiece 106 and configured as a direct drive, for example.

The apparatus 100 optionally comprises an indexing head 120. The indexing head 120 is connected to the frame or to the ground 112, for example. For example, the indexing head 120 is supported by the stands 104, 106 or the table frame 110. The indexing head 120 is configured to pick up the workpiece to be machined and hold it during a punching process. Furthermore, the indexing head 120 is configured to rotate the workpiece 102 about an indexing head axis 122. To this end, the indexing head 120 exemplarily comprises suitable rotation means, for example in the form of an electric motor. The indexing head axis 122 is oriented along the y axis and offset from the punching axis 116. According to this embodiment, the indexing head axis 122 and the punching axis 116 are offset along the z axis. According to an embodiment, a plane including the indexing head axis 122 and the punching axis 116 extends in parallel to a y-z plane.

According to an embodiment, the apparatus 100 comprises means 124 for moving the workpiece 102 or of the entire indexing head 120 transversally to the workspace plane, here for moving along the z axis. In this way, a center of the workpiece 102 may be moved to and/or away from the workspace. Here, a distance between the indexing head axis 122 and the punching axis 116 may be changed. According to an embodiment, the means 124 or other means is configured to additionally or alternatively move the workpiece 102 or the entire indexing head 120 along the x axis.

According to an embodiment, using the indexing head 120 or using other moving means, the workpiece 102 may be moved so that the entire workpiece 102 is moved completely through the workspace opened up by the frame. Here, the center of the workpiece 102 is also moved through the entire workspace.

According to an embodiment, an upper tool part is arranged on the free end of the plunger 114, here the end facing the table frame 110, and a lower tool part is arranged on a side of the workpiece 102 facing away from the plunger 114. For example, the lower tool part is arranged on a table plate of the apparatus 100 coupled to the frame. By moving the plunger 114 along the punching axis 116 in the direction of the table frame 110, a notch can be produced in the workpiece 102 using the upper tool part and the lower tool part.

The tool parts may be tool parts as already employed in notching presses. Together with the lower tool part, the upper tool part may form a tool cartridge.

According to an embodiment, in a so-called upstroke, the plunger 114 may be moved so far to a top reversal point that continuous gap through which the workpiece, which is the unmachined workpiece and/or the machined workpiece, and particularly also a center of the workpiece can be moved forms between the upper tool part and the lower tool part. Thus, the gap may extend along a plane extending transversely to the y axis. To this end, the upper tool part at the lower tool part are arranged to be spaced from each other without overlap. Without overlap can be understood to mean that the tool parts may be moved relative to each other along the z axis and along the x axis without the tool parts coming into contact with each other. When the plunger 114 is at the top reversal point, an end of the upper tool part facing away from the headpiece 106 is arranged more closely to the headpiece 106 than an end of the lower tool part facing the headpiece 106.

FIG. 2 shows a sectional view of an apparatus 100 for notching according to an embodiment. It may be a section through the apparatus described on the basis of FIG. 1 along a sectional plane extending in parallel to the x-z plane.

What is shown of the apparatus 100 is a section through the first stand 104 and the second stand 108 as well as a top view onto the table frame 110. Moreover, an upper tool frame of an upper tool part 230 of the apparatus 100 is shown. The upper tool part 230 is movable along the punching axis 116 described on the basis of FIG. 1. The upper tool part 230 exemplarily comprises two through-holes serving as tool guides 232.

The workpiece 102, also referred to as sheet 102 in the following, is shown at two positions. The unmachined workpiece 102, which is supplied to the apparatus 100 by means of a first movement 234 and is placed on the indexing head of the apparatus 100 described on the basis of FIG. 1, for example, is shown at the position illustrated the top in FIG. 2. The first movement 234 corresponds to a loading of the apparatus 100. Correspondingly, the workpiece 102 is shown at a second position illustrated at the bottom FIG. 2. At the second position, the workpiece 102 may be machined. Following machining, the machined workpiece is moved away from the apparatus 100 by means of a second movement 236. The second movement 236 corresponds to an unloading of the apparatus 100.

The first movement 234 and the second movement 236 are in alignment with each other. The movements 234, 236 extend along a longitudinal movement axis extending along the z axis. Thus, the workpiece 102 is guided completely through the workspace opened up by the frame of the apparatus 100. In particular, a center 238 of the workpiece 102 is guided through between the first stand 104 and the second stand 108. As can be seen from FIG. 2, the longitudinal movement axis is oriented orthogonally with respect to a main direction of extension of the table frame 110 and thus of the headpiece.

A hatched area of the workpiece 102 shown at the second position represents a region in which there is space for a sucker or grabber when removing the workpiece 102. Since the workpiece 102 is removed parallel to the z axis, the region also extends into a section between the upper tool part 230 and the stands 104, 106.

The workpiece 102 is exemplarily shown as a round sheet 102. Alternatively, a differently shaped, for example rectangular blank 240 may be machined correspondingly.

According to an embodiment, the apparatus 100 is realized as a machine which may either be a manual loading machine or a machine. In manual loading machines, the workpieces 102, here for example sheets 102, are manually loaded and removed again. According to an embodiment, when rotor and stator are separated during punching, it is very challenging to remove the stator sheet again from the machine without damage, because the back of the sheets 102 may be very thin after the completed notching, as shown in FIG. 3, for example, and the sheets 102 may thus lack stability and hence cannot be removed manually without deformation. In case of an automated solution, it is important to position the removing grabbers so as to be uniformly distributed across the back of the sheet.

Realizing the apparatus 100 as a notching press with an O frame results in a number of advantages. The possible depth or outreach of the tools including the tool guides 232 arranged on the outside and the possibility of including notches distant from the outer diameter are unlimited. Moreover, the tool may be installed from behind. When installing the tool along the z axis, a support table for the workpiece 102 is not in the way. In the case of the O frame, the deflection of the punch press is symmetrical and thus unproblematic due to the very small cutting clearance of the tools. Furthermore, not only round blanks can be punched. Thus, the workpieces do not have to be precut correspondingly, whereby an additional machining step may be omitted. Moreover, in the case of automation, the sheets 102 can be removed and supplied both from the front and from the back, because the sheet 102 can be moved laterally out of the tool due to the construction of the sheet grabbers. The possible loading and unloading in the same direction saves a lot of time. If the sheets 102 are removed laterally from the machine, grabbers may be installed in the top region. Thereby, the sheet 102 stays stable when transported and cannot deform plastically.

According to an embodiment, these advantages are obtained when the machine frame is realized as an O frame, optionally comprising a drive concept based on a direct drive.

According to an embodiment, the machine frame is constructed as an O frame. Here, the "O" is formed by the stands 104, 108, the headpiece 106 and the table frame 110. Optionally, a drive directly driving the plunger centrally arranged in the machine frame is employed. According to an embodiment, the depth of the frame is made as small as possible, in order to achieve good accessibility for manual feeding as well as short paths for automation. The width of the frame may be adapted continuously to the maximum sheet diameter. The correspondingly further outreach of a rectangular sheet 240 may also be adapted to without any problems. Owing to the O frame, the deflection of the machine still remains symmetrical, which has a positive effect on the service life and the quality of the cut.

The tool can be installed and dismantled in a very simple and well accessible manner on the backside of the machine.

A further advantage consists in the simple possibility of automation, because a punched sheet 102 can be removed to the front, and at the same time a new sheet 102 can be supplied from behind in one direction. The ancillary times of the automation are reduced considerably, and thereby the turnout is increased considerably. This is illustrated on the basis of the loading and unloading concept of a notching press with an O frame shown in FIG. 2, wherein processing rectangular blanks 240 is also possible with the concept of the O frame.

FIG. 3 shows a schematic diagram of a machine workpiece in form of a stator 302 or stator sheet according to an embodiment. What is shown is a portion of a back of the stator 302. For example, the stator 302 may have been punched by the apparatus described on the basis of the preceding figures.

FIG. 4 shows an illustration of a frame of an apparatus for notching according to an embodiment. It may be an embodiment of the frame described on the basis of FIG. 1. The frame represents a machine frame realized as an O frame.

The frame includes the first stand 104, the headpiece 106, the second stand 108 and the table frame 110. Two rails 450 for guiding the indexing head and a table plate 452 for the lower tool are arranged on a side of the table frame 110 facing the headpiece 106.

FIG. 5 shows a schematic illustration of a drive 118 for an apparatus for notching according to an embodiment. It may be an embodiment of the drive shown on the basis of FIG. 1.

The drive 118 is realized as a direct drive and includes an electric motor 560 with a rotor 562 and a stator 564 and an eccentric shaft 566 having an eccentric 568 and drivable by the electric motor 560. According to this embodiment, the eccentric shaft 566 is connected directly to the rotor 562. The eccentric 568 is coupled to a connecting rod 570 via bearing 572 for the connecting rod 570. The connecting rod 570 is coupled to the plunger shown in FIG. 1, for example, in the operational state of the apparatus.

Optionally, the drive 118 comprises a housing 574, and the eccentric shaft 566 is attached to the housing 574 via a bearing 576 of the housing 574. For example, the housing 574 encloses the electric motor 560.

The drive 118 may be arranged on the headpiece of the apparatus shown in FIG. 1 or integrated into the headpiece.

According to an embodiment, the drive 118 represents a main drive of the apparatus and is realized as a direct drive with the electric motor 560 in form of a torque motor. Here, dynamic balancing of masses may be provided.

Due to the direct drive and a corresponding design of the drive 118, at a very high stroke rate, the main drive may be operated in pendular operation. The plunger stroke may be adjusted freely, and thereby both the freedom of movement of the tool and the interaction between main drive and indexing head may be programmed and optimized depending on the process.

For example, if the speed of the indexing head is the limiting factor, the main drive may operate at higher dynamics in shorter time so as to give the indexing head more time. This optimization may also be applied vice versa. Due to the pendular motion and the lower plunger stroke, the impact velocity may be reduced significantly, which is very advantageous for the service life of the tools.

Advantageously, no additional axis is needed for the upstroke, which can be realized simply by suitable positioning, i.e. by stopping at the top dead center.

The drive 118 in form of a drive unit optionally is mounted in the separate housing 574 and may be dismounted very easily from the basic frame of the apparatus for purposes of maintenance or replacement.

Another advantage in connection with the O frame and a concept of automation in which the workpiece is moved through the apparatus consists in the fact that during the pendular motion correspondingly constructed guides of the tool may remain engaged and are separated from each other only during the upstroke, so that enough space for feeding the workpiece through the apparatus is obtained.

FIG. 6 shows a schematic illustration of a tool cartridge for an apparatus for notching according to an embodiment. The tool cartridge includes an upper tool part 230 and a lower tool part 630. In the assembled state, for example, the upper tool part 230 is attached to the free end of the plunger shown in FIG. 1, and the lower tool part 630 is attached to the table plate shown in FIG. 4.

The upper tool part 230 includes at least one, here exemplarily two upper guiding elements 632. The lower tool part 630 includes at least one, here exemplarily two lower guiding elements 634. The upper guiding elements 632 and the lower guiding elements 634 each comprise guiding faces along which the mutually corresponding guiding elements 632, 634 may slide along each other when the upper tool part 230 is moved along the punching axis 116.

During a punching process, the upper tool part 230 performs a punching stroke, for example in form of a pendular stroke if using a direct drive. The lengths of the guiding faces with respect to the direction of the punching axis 116 are chosen so that a guiding length 636 at least corresponds to the maximum punching stroke. In this way, the parts are guided safely by the guiding elements 632, 634 during the punching process.

According to an embodiment, the guiding elements 632, 634 are removably connected to the tool parts 230, 630 and may be removed following the installation of the tool cartridge in the apparatus for notching. This facilitates moving the workpiece through between the tool parts 230, 630.

FIG. 7 shows a schematic illustration of the tool cartridge described on the basis of FIG. 6 for apparatus for notching according to an embodiment.

The tool cartridge is shown in an upstroke, in which the upper tool part 230 has been moved further away from the lower tool part 630 along the punching axis 116 than in a punching process, in order to enable supplying or removing a workpiece 102.

The upper guiding faces 732 of the upper guiding elements 632 and the lower guiding faces 734 of the lower guiding elements 634 are provided with reference numerals in FIG. 7.

During the upstroke, the upper tool part 230 may have a maximum stroke 734. Thus, the tool cartridge may be maximally open.

According to an embodiment, the plunger is moved so far to a top reversal point, for example the top dead center, that the guiding elements 632, 634 no longer overlap and a continuous gap greater than a thickness of the workpiece 102 is formed between the tool parts 230, 630. When the workpiece is guided through between the tool parts 230, 630, the upper tool part 230 is completely above the workpiece 102 and the lower tool part 630 is completely below the same.

If a direct drive is employed for driving the plunger, due to pendular motion, movement during the punching can be only in the lower region of the guiding elements 632, 634 shaped as guides, which is where the suitably constructed guiding elements 632, 634 always remain immersed and ensure the necessary guidance for the small cutting clearances. Following completion of the punching process, according to an embodiment, the plunger is moved to the top dead center, which corresponds to the upstroke. Thereby, the guiding elements 632, 634 are moved apart so that the apparatus can be loaded from behind passing above and below the separated guiding elements 632, 634 when using an O frame.

The tool cartridge as shown thus is provided with guides 632, 634, 732, 734 that ensure exact guidance with little tool travel, e.g. in a pendular motion, and can be separated from each other in an upstroke so that there is sufficient clearance to feed parts, such as the workpiece 102, to the apparatus between the separated tool parts 230, 630 and between the guiding elements 632, 634, as shown on the basis of FIG. 2.

FIG. 8 shows a machined workpiece 802 according to an embodiment, produced from an unmachined workpiece using the apparatus described on the basis of FIG. 1, for example. The workpiece 802 is a circular sheet into which through-holes have been punched. The through-holes here are arranged along an outer ring and optionally along inner ring. According to this embodiment, the through-holes along the inner ring only serve as air holes. According to an embodiment, the workpiece 802 is a sheet produced by means of intermittent punching.

FIG. 9 shows a schematic illustration of a punching system 900 according to an embodiment. The punching system 900 is used to machine an unmachined workpiece by an apparatus 100 for notching, for example an apparatus as is described on the basis of the preceding figures, so as to obtain a machined workpiece, consisting of a stator and a rotor according to this embodiment.

Apart from the apparatus 100, the punching system 900 includes a providing unit 910, optionally an aligner 912 for aligning the unmachined workpiece, a first repository 914, optionally a second repository 916 and a moving unit 918. The apparatus 100 is arranged between the providing unit 910 at the first repository 914. The providing unit 910, the apparatus 100, the first repository 914 and the second repository 916 are arranged in a row.

The providing unit 910 is configured to provide unmachined workpieces. The moving unit 918 is configured to pick up an unmachined workpiece from the providing unit 910 and move it to the apparatus 100 by way of a first movement along a longitudinal movement axis 920. Thus, the moving unit 918 is configured to load the apparatus 100 with the unmachined workpiece. Optionally, the aligner 912 is configured to align the unmachined workpiece upon receipt from the providing unit 910. The apparatus 100 is configured to punch at least one notch into the unmachined workpiece to produce the machined workpiece. The moving unit 918 is configured to pick up the machined workpiece from the apparatus 100 following the punching process and move it to the first repository 940 by way of a second movement along a longitudinal movement axis 920, and to deposit the machined workpiece, or part of the machined workpiece according to this embodiment, here the stator, on the first repository 940. Thus, the moving unit 918 is configured to empty the apparatus 100. The first movement and the second movement have the same direction along the longitudinal movement axis 920.

According to the embodiment shown, the 918 is configured to the rotor further to the second repository 916 by way of a third movement and deposit it on the second repository 916. The third movement has the same direction as the first movement and the second movement along the longitudinal movement axis 920. Thus, the moving unit 918 is configured to the workpiece by way of unidirectional movements along the longitudinal movement axis 920.

According to an embodiment, the workpiece is moved through the frame, i.e. between the stands, of the apparatus 100. In this case, the longitudinal movement axis 920 is aligned in parallel to the z direction of the apparatus 100.

The punching system 900 shown in FIG. 9 represents an overall machine having the apparatus 100 in form of a notching press with an O frame and direct drive in combination with line automation.

According to an embodiment, the punching system 900 shown in FIG. 9 is based on the apparatus 100 in form of a notching press with an O frame, a direct drive with pendular movement and upstroke as well as a tool cartridge with guides along the pendular stroke.

Thereby, moving the sheets through the apparatus 100 becomes possible. The sheets can be moved through on the shortest path in the same direction on one line. The direct drive with pendular motion and upstroke offers the advantage that a sheet can be moved through the apparatus 100. The tool cartridge with guides along the pendular stroke also offers the advantage that a sheet can be moved through the apparatus 100.

The reduced number of axes, because no transverse movement is necessary, and both the short paths of travel and the small size ratio are advantageous with respect to the arrangement of the apparatus 100 and the automation in one line.

The invention claimed is:

1. Apparatus for single notching, wherein the apparatus is configured for producing stator and rotor sheets for electric machines and comprises:

a frame with a first stand, a second stand and a headpiece, wherein the stands are arranged to be offset from each other along an x axis, wherein the headpiece spans a gap between the stands, and wherein the stands and the headpiece form an archway surrounding a workspace, and wherein the frame comprises a table frame connecting the first stand and the second stand, wherein the headpiece and the table frame are arranged to be offset from each other along the y axis, wherein two rails for guiding an indexing head and a table plate for a lower tool are arranged on a side of the table frame facing the headpiece;

a plunger, which is coupled to the headpiece and is movable along a punching axis extending along a y axis; and an upper tool part and the lower tool part, the upper tool part and the lower tool part configured to punch a notch in a workpiece during a punching process, wherein the upper tool part is attached to a free end of the plunger and the lower tool part is attached to the table plate coupled to the frame opposite the upper tool part, and wherein the plunger is movable to a top reversal point at which the upper tool part and the lower tool part are spaced apart from each other without overlap, wherein the upper tool part includes at least one upper guiding element and the lower tool part includes at least one lower guiding element, wherein the at least one upper guiding element and the at least one lower guiding element each comprise a guiding face along which the mutually corresponding guiding elements may slide along each other when the upper tool part is moved along the punching axis during the punching process, wherein the indexing head is for accommodating the workpiece to be machined, and the indexing head is configured to hold the workpiece and to rotate the workpiece about an indexing head axis running through the workpiece and being oriented along the y axis during the punching process, wherein the indexing head axis and the punching axis are arranged to be offset from each other along a z axis during the punching process, wherein the x axis, the y axis and the z axis each are oriented orthogonally with respect to each other, and wherein the indexing head is configured to move the entire workpiece transversally along the z axis completely through the workspace opened up by the frame, wherein a center of the workpiece is guided through along the z axis between the first stand and the second stand.

2. Apparatus according to claim 1, wherein the indexing head is configured to move the workpiece along the z axis and along the x axis.

3. Punching system, comprising:

a providing unit for providing an unmachined workpiece;

an apparatus according to claim 1, wherein the apparatus is configured to punch at least one notch into the unmachined workpiece, in order to obtain at least one machined workpiece;

a repository for depositing the machined workpiece; and a moving unit configured to move the unmachined workpiece from the providing unit to the apparatus and to move the machined workpiece from the apparatus to the repository, wherein the apparatus is arranged between the providing unit and the repository, and wherein the providing unit, the apparatus and the repository are arranged in a row.

* * * * *